US007846002B1

(12) United States Patent
Mikesell et al.

(10) Patent No.: US 7,846,002 B1
(45) Date of Patent: Dec. 7, 2010

(54) LIGHTED TOY CONSTRUCTION BLOCKS

(76) Inventors: Daniel G. Mikesell, 204 Meserole St., Apt. #2, Brooklyn, NY (US) 11206; Caroline S. Eastman-Bridges, 183 Center Cambridge Rd., Valley Falls, NY (US) 12183

( * ) Notice: Subject to any disclaimer, the term of this patent is extended or adjusted under 35 U.S.C. 154(b) by 715 days.

(21) Appl. No.: 11/429,761

(22) Filed: May 8, 2006

Related U.S. Application Data

(60) Provisional application No. 60/678,270, filed on May 6, 2005.

(51) Int. Cl.
*A63H 17/00* (2006.01)

(52) U.S. Cl. ..... 446/91; 446/92

(58) Field of Classification Search ..... 446/91
See application file for complete search history.

(56) References Cited

U.S. PATENT DOCUMENTS 3,237,341 A 3/1966 Janning
3,696,548 A * 10/1972 Teller ..... 446/91
4,501,568 A * 2/1985 Nagaoka ..... 446/450
4,552,541 A 11/1985 Bolli
4,556,393 A 12/1985 Bolli
4,643,695 A * 2/1987 Kennedy et al. ..... 446/427
4,743,202 A 5/1988 Bach
4,883,440 A 11/1989 Bolli
4,894,040 A 1/1990 Bach et al.
5,088,951 A 2/1992 Majurinen
5,411,428 A 5/1995 Orii et al.
5,455,749 A 10/1995 Ferber
6,062,937 A 5/2000 Kikuchi
6,414,906 B1 * 7/2002 Gaspari ..... 367/139
6,443,796 B1 9/2002 Shackelford
6,575,802 B2 6/2003 Yim et al.
6,585,553 B1 7/2003 Fetridge et al.
6,679,751 B1 1/2004 Maxwell et al.
6,805,605 B2 10/2004 Reining et al.
7,322,873 B2 * 1/2008 Rosen et al. ..... 446/91
2003/0025505 A1 * 2/2003 Lam ..... 324/426
2003/0148700 A1 8/2003 Arlinsky et al.
2003/0214259 A9 * 11/2003 Dowling et al. ..... 315/312
2005/0026537 A1 2/2005 Hsieh et al.

* cited by examiner

*Primary Examiner*—Gene Kim
*Assistant Examiner*—Michael D Dennis
(74) *Attorney, Agent, or Firm*—Baker & Daniels LLP

(57) ABSTRACT

A set of blocks is provided. The set includes some blocks having an internal light which is illuminated when blocks are stacked together.

21 Claims, 14 Drawing Sheets

LIGHTED TOY CONSTRUCTION BLOCKS

CROSS REFERENCE TO RELATED APPLICATIONS

This application claims the benefit of U.S. Provisional Application Ser. No. 60/678,270, filed on May 6, 2005, which is expressly incorporated by reference herein.

BACKGROUND AND SUMMARY OF THE INVENTION

The present invention relates to a set of blocks that glow with an internal light when they are stacked together. More particularly, a set of blocks is formed from a translucent, soft elastic material containing an internal light source, such as LEDs, and the circuitry to power the light source when the blocks are connected to each other and to a power source such as a power supply block. The circuitry illustratively conducts electricity through the blocks to light a series of connected blocks.

In an illustrated embodiment the circuitry provides for more than one color to appear in a given block, depending on polarity of the connection. Some of the blocks contain circuitry for special effects such as pulsing light, changing light color and/or light changing intensity based on an ambient noise level. The set of blocks is suitable both as a toy for children and for light sculpture and design applications.

In one illustrated embodiment, a block apparatus comprises a body formed from an elastic material, a light source located within the body, and a pair of conductors to conduct electricity though the body from an adjacent block to supply power to the light source.

In another illustrated embodiment, a block apparatus comprises a body, a light source located within the body, and a pair of conductors to conduct electricity though the body and power the light source. The pair of conductors illustratively have first and second magnetic contacts located adjacent a first surface of the body and a first and second metallic contacts located adjacent a second surface of the body.

In yet another illustrated embodiment, a block set comprises at least one power block including a body, at least two contacts on the body, and a source of electricity coupled to the at least two contacts. The set further comprises a plurality of first blocks, each of the of the first blocks having a body, a pair of first contacts located adjacent to a first surface of the body, a pair of second contacts located adjacent to a second surface of the body, and a light source located within the body. The light source is electrically coupled between the pairs of first and second contacts. The set still further comprises a plurality of second blocks, each of the of the second blocks having a body, a pair of first contacts located adjacent to a first surface of the body, a pair of second contacts located adjacent to a second surface of the body, and a pair of conductors extending through the body to couple the pairs of first and second contacts together to pass electricity through the second block. The plurality of first and second blocks are selectively stackable on the power block with a pair of first contacts of one block engaged with a pair of second contacts on an adjacent block to conduct electricity through a plurality of stacked blocks so that first blocks in the stack are lighted and second blocks in the stack are non-lighted.

Additional features of the invention will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
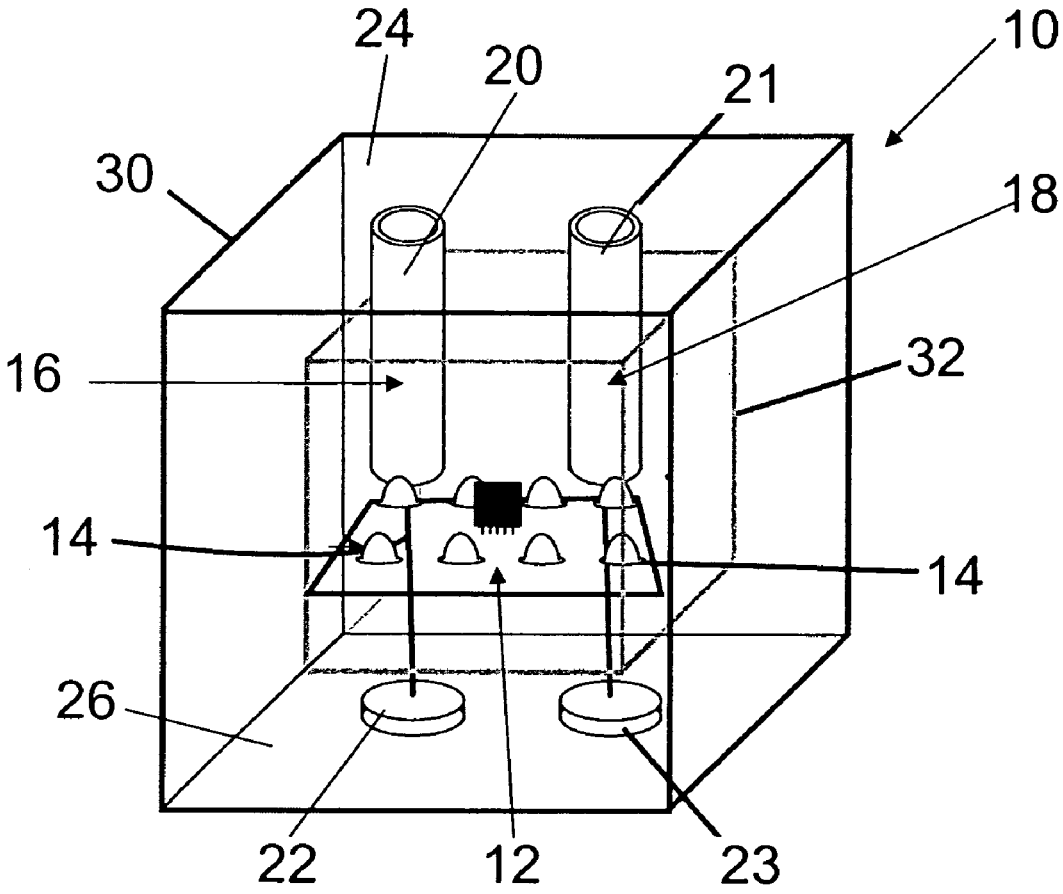
FIG. 1 is a perspective view of an illustrated embodiment of a lighted building block of the present invention.

Referring now to the drawings, an illustrated embodiment of the present invention is shown in FIG. 1. A block 10 includes a circuit board 12 having a plurality of lights such as LEDs 14 located thereon. The block 10 includes first and second connectors 16 and 18 which are electrically coupled to the circuit board 12 to power the LEDs 14 and to conduct electricity through the block 10. Connectors 16 and 18 include first and second upper contacts 20 and 21 located adjacent to a top surface 24 of block 10, and first and second lower contacts 22 and 23 located adjacent a bottom surface 26 of block 10. Connectors 16 and 18 are discussed in more detail below.

In the illustrated embodiment, an elastic material 30 is poured or otherwise located over the circuit board 12, LEDs 14 and connectors 16 and 18 to position these components within the elastic material 30 and form the block 10. The formation is typically done in a mold.

An optional plastic inner core 32 may be provided around the circuit board 12 and LEDs 14. This plastic inner core 32 protects the electronics and is also less expensive than the elastic material 30. When the inner core 32 is used, less elastic material is required to form the block. In addition, the plastic core 32 may act as a light diffuser so that light from the individual LEDs 14 is not seen directly through the blocks 10. The plastic inner core 32 may either be a hollow plastic body or a solid plastic piece molded around the circuit board 12 and LEDs 14. In another embodiment, the elastic material 30 may provide the diffuser through tinting the material or otherwise with or without the use of the inner core 32.

The blocks 10 are illustratively made of a solid or semi-solid translucent or semi-translucent elastic material construction. The construction of the blocks 10 permits the blocks to transmit light. The elastic construction material is illustratively, but not limited to, silicone, urethane, rubber or the like. The elastic material is illustratively soft and flexible so it allows blocks 10 to bounce (like a Superball) and allows the construction to transmit light. In another illustrated embodiment, the elastic material contains antimicrobial polymers so that the blocks are resistant to microbial contamination.

Figure 2:
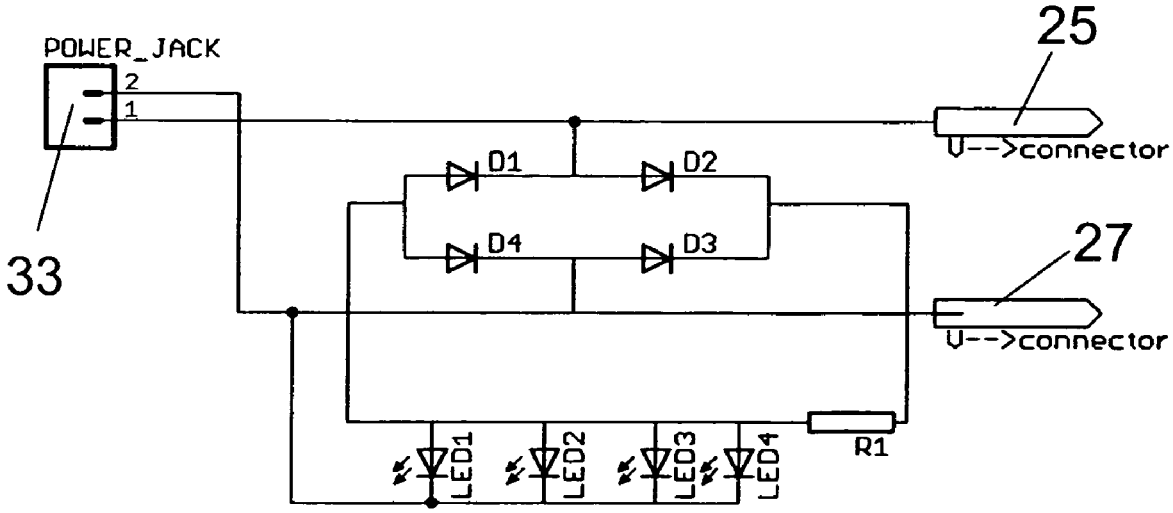
FIG. 2 is a schematic view illustrating a power block for supplying electricity to the various building blocks of the present invention.

The blocks are illustratively powered by a power block. A first illustrated power block is connected directly to an AC outlet. An example power block is illustrated in the schematic drawing in FIG. 2. Within the circuitry of the block there is a 9V (or similar) converter with the possibility of a GFCI unit as illustrated at block 33. The power jack 33 is coupled to an array of diodes D1-D4 and to an array of LEDs (LED1-LED4) as shown in FIG. 2. Connectors 25 and 27 are configured to be coupled to, for example, contacts 22 and 23 of block 10 to provide power to block 10.

In another embodiment, the power block includes contacts and replaceable batteries. Yet another power block includes a rechargeable battery. In this embodiment, the entire block can be set onto a recharging station for repeat use.

These power blocks are illustratively one of the standard sizes of blocks in the set so they can be disguised as one of the other blocks and not appear to be a distinctive block.

The blocks are illustratively lit with a variety of different colored LEDs. The blocks are preferably lit uniformly without 'hotspots'. This may be accomplished, for example, by using the optional plastic inner core 32 shown in FIG. 1 as a diffuser as discussed above.

Figure 3:
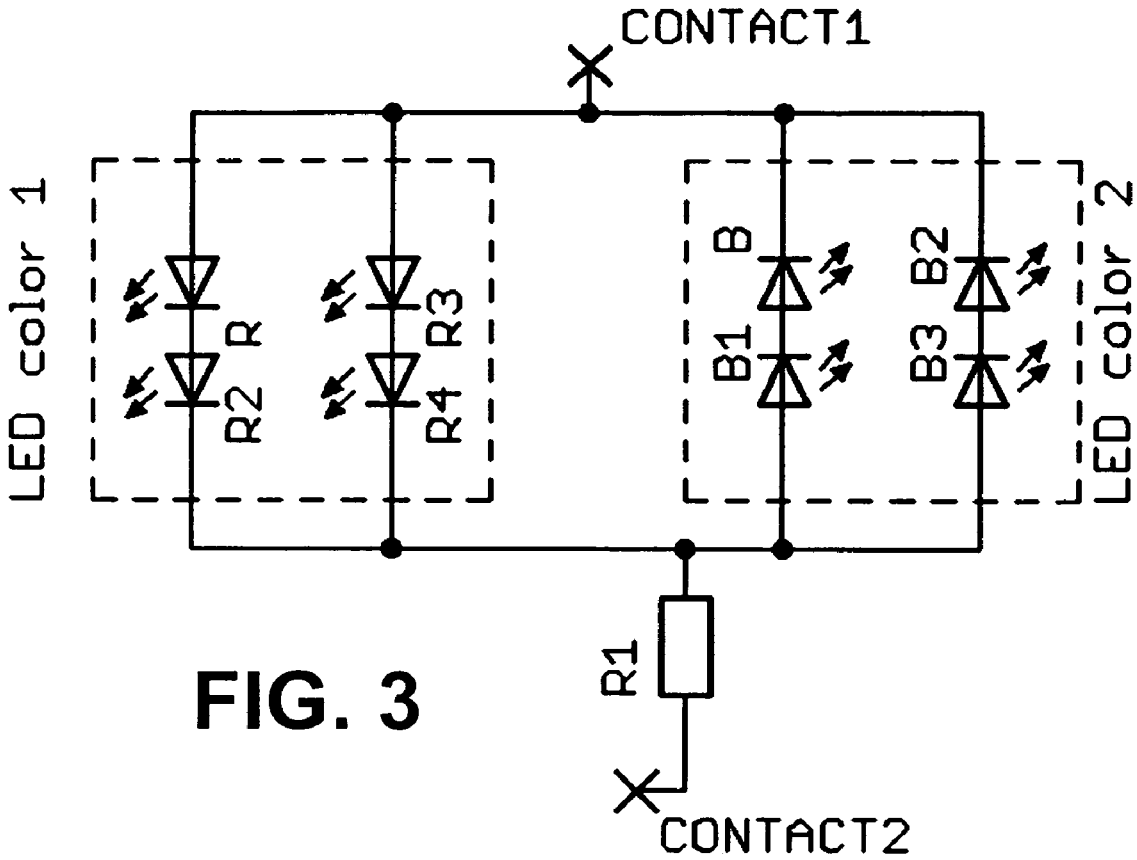
FIG. 3 is a schematic view illustrating an example lighting circuit which includes different color lights depending on the polarity in which block is connected.

Certain blocks may illustratively contain two or more colors of LEDs. The polarity of the connectors 16, 18 illustratively determines which color LEDs will light in a given configuration. In other words, if a user switches the blocks 10 so that different contacts 20-23 are connected, a different color of LEDs will be lighted. Therefore, by simply reversing the orientation of the blocks 10, a different color light can be emitted. In FIG. 3, a first set of LEDs (R-R3) is lighted in a first orientation, and a second set of LEDs (B-B3) is lighted in a second orientation. In other embodiments, alternative methods, such as switches, may be used to change colors of the lights.

Figure 4:
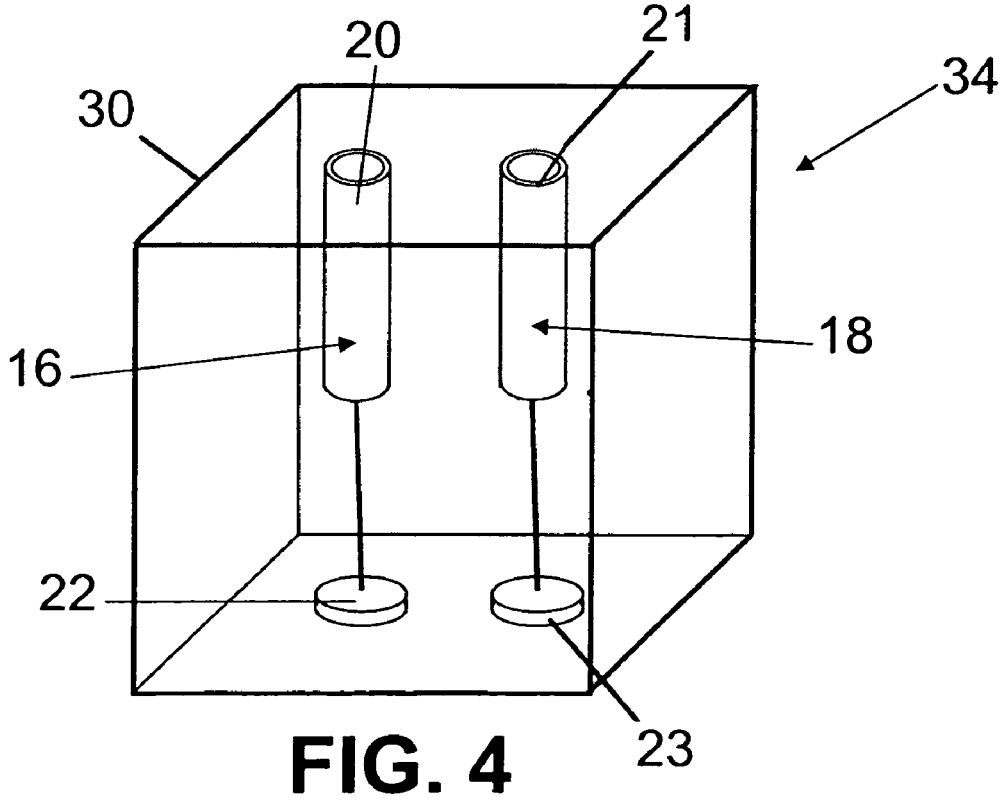
FIG. 4 is a perspective view illustrating a non-lighted block which contains circuitry to pass electricity through the block but which does not contain a light.

A set of blocks may also contain a number of blocks 34 shown in FIG. 4 which contain circuitry to conduct electricity through the blocks 34, but do not include LEDs or other light source. These are called "black" or "blank" blocks not because of their color, but to indicate that they do not light up. The inclusion of blank blocks 34 allows a builder to create light sculptures that appear to "float".

Figure 11:
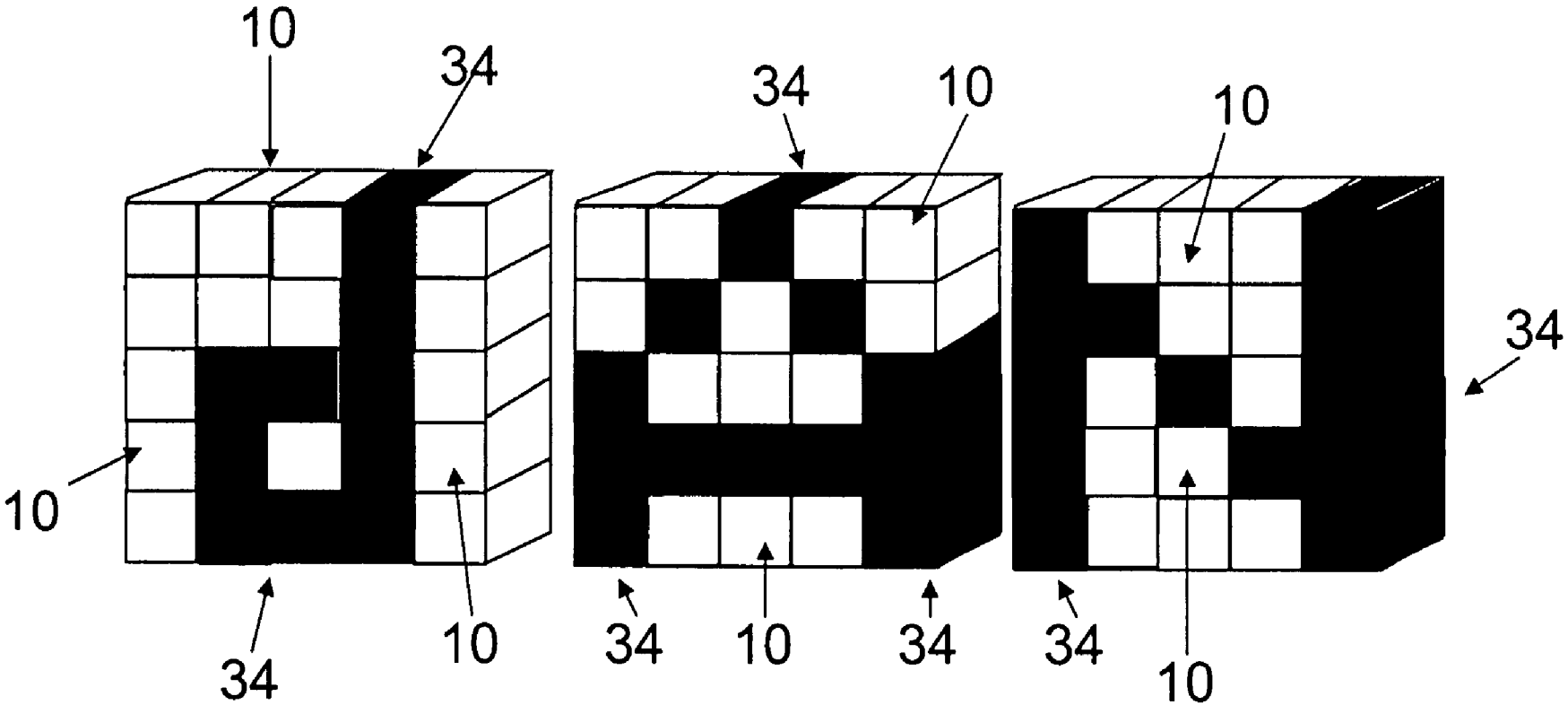
FIG. 11 is the perspective view illustrating a plurality of blocks including a stacked combination of lighted blocks and non-lighted blocks used to create a design.

FIG. 11 illustrates an example of how the blank blocks 34 are used in a construction. White blocks 10 in FIG. 11 illustrate the lighted blocks, and black blocks 34 are blank, non-lighted blocks. The name "d-A-N" is spelled out in FIG. 11. The combination of lighted blocks 10 and blank blocks 34 may be used to create various designs.

Figure 5:
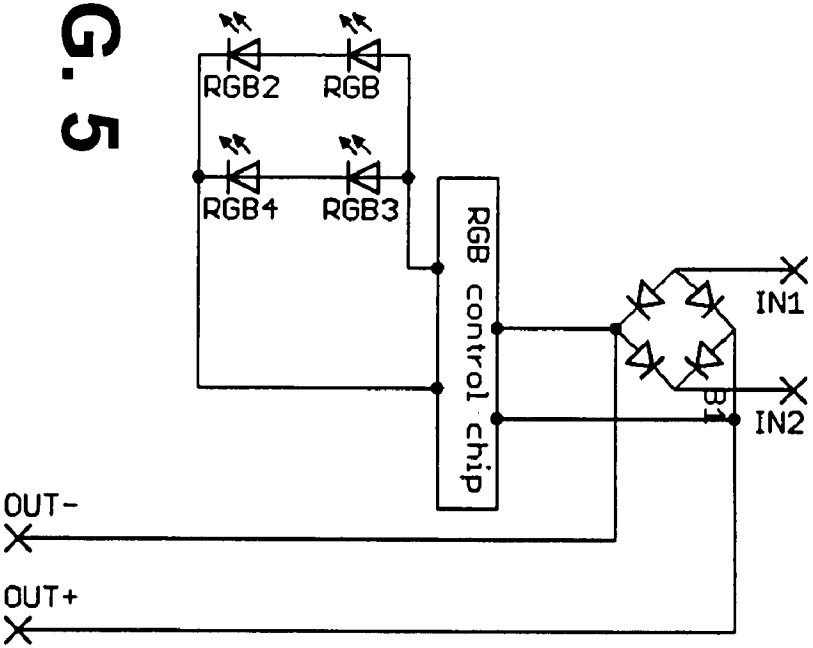
FIG. 5 is a schematic diagram of a RGB block which is alternately illuminated with different colors.
Figure 6:
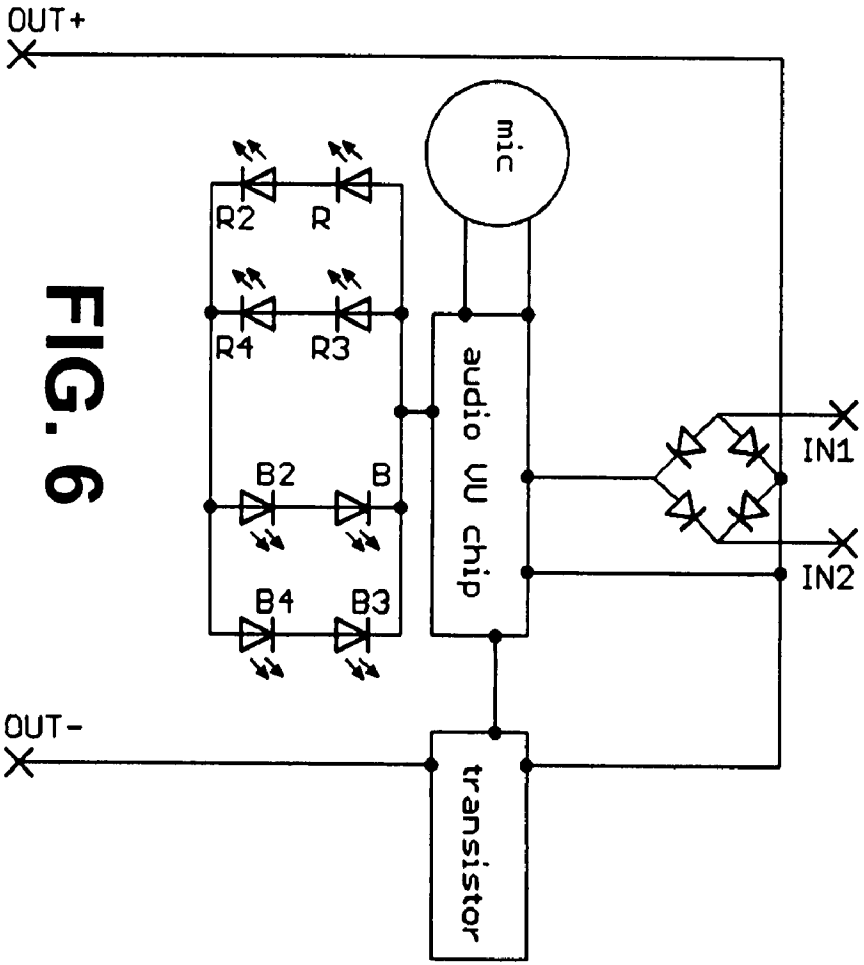
FIG. 6 is a schematic diagram illustrating a block which includes a microphone and an audio chip in addition to the lights so that the intensity of the emitted light varies based on detected ambient noise levels.

Other blocks features illustratively include:

1. Blinking blocks: Block that blink or pulse.
2. Red-Green-Blue (RGB) blocks: Blocks that are lit with RGB LEDs and/or rotate thru the different colors. See FIG. 5.
3. Peak amp blocks: Blocks that brightness is dependent of ambient noise. This block includes a microphone and an audio chip will effect the brightness of all blocks placed in a construction on top of it based on detecting ambient noise as shown in FIG. 6.
4. Motor blocks: Blocks that include internal electric motors to perform specified functions.

The blocks 10, 34 illustratively use connectors that both hold the blocks in position and close the circuit to light the LEDs 14 or power the other internal components, if any. The illustrated embodiments include three different connector types. These connectors serve the function of holding the blocks together and also closing the electrical circuit. It is understood that other connector configurations may also be used in accordance with the present invention.

Figure 7A:
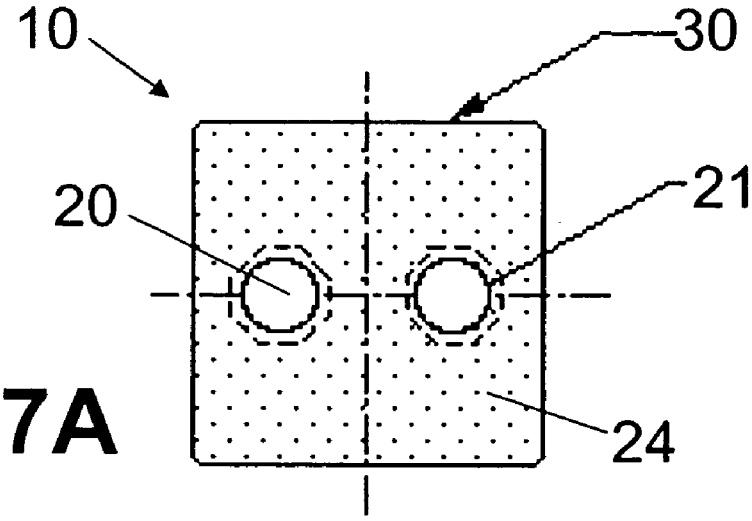
FIG. 7A is a top view of a building block illustrating the location of the pair of sliding upper electrical connectors.
Figure 7B:
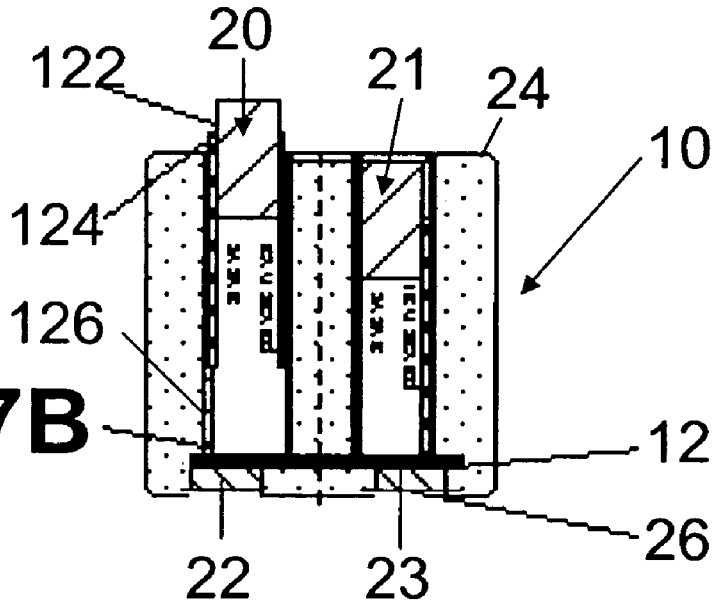
FIG. 7B is a sectional view illustrating the sliding connectors adjacent the top portion of the block and magnetic lower connectors adjacent a bottom portion of the block.
Figure 7C:
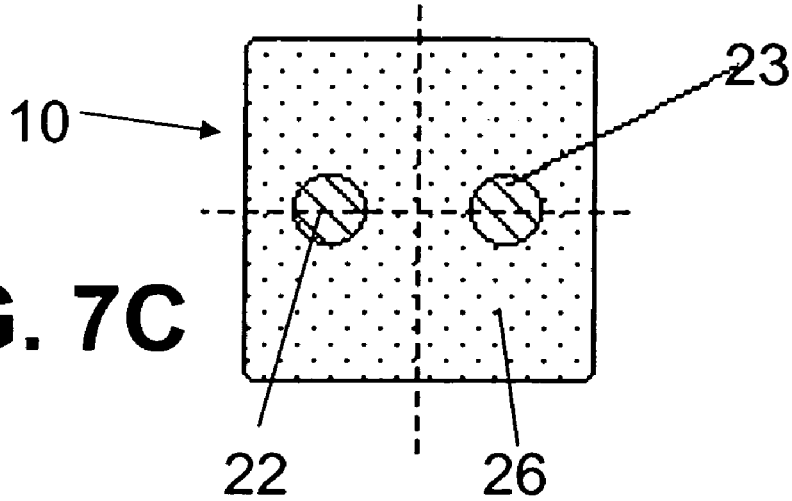
FIG. 7C is a bottom view of the block of FIGS. 7A and 7B illustrating the location of the magnetic lower connectors located adjacent a bottom surface of the block.

The first type of connectors include a pair of magnets 22, 23 which provide contacts on the bottom surface 26 of a block as shown in FIG. 7C. Connectors also include a pair of metal discs or rods 20, 21 which are not magnetized located adjacent the top surface 24 of the block 10 to provide the pair of contacts 20, 21 as shown in FIG. 7A.

FIG. 7B illustrates movable contacts 20, 21 formed by a metal rod 122 located in a first movable metal tube 124. First metal tube 124 slides up and down inside a fixed, second metal tube 126. Illustratively, tube 126 is electrically coupled to circuit board 12, and circuit board 12 is electrically coupled to the magnetic contacts 22, 23. Electricity flows through rod 122, first tube 124, and second tube 126 to printed circuit board 12 and then to magnetic contacts 22, 23. When magnetic contacts 22, 23 of an adjacent block are located near rods 122, rods 122 are attracted by the magnetic contacts 22, 23 respectively, and move out of second tube 126 to an extended position shown (exaggerated) in FIG. 7B. This magnetic attraction holds adjacent blocks together, powers the internal circuitry, and passes electricity to an adjacent connected block.

Figure 8A:
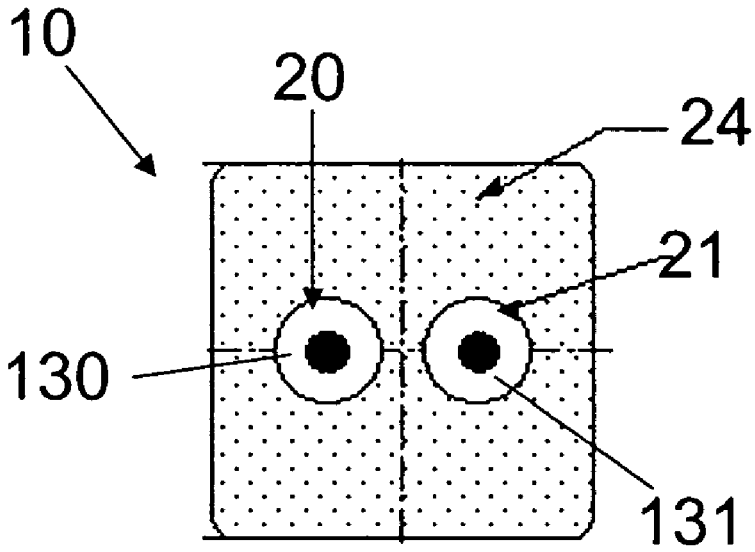
FIG. 8A is a top view of another embodiment of a block having female snap connectors for making electrical contact to an adjacent block.
Figure 8B:
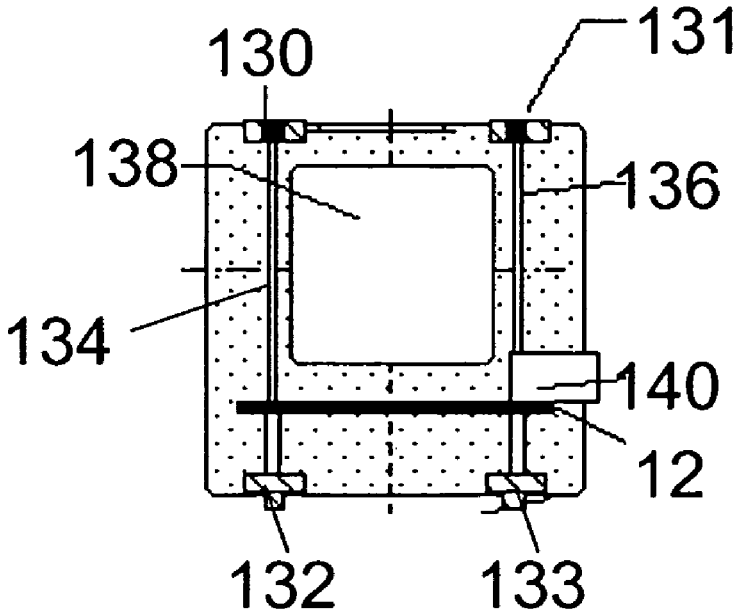
FIG. 8B is a sectional view further illustrating the electrical circuitry within the block of FIG. 8A.
Figure 8C:
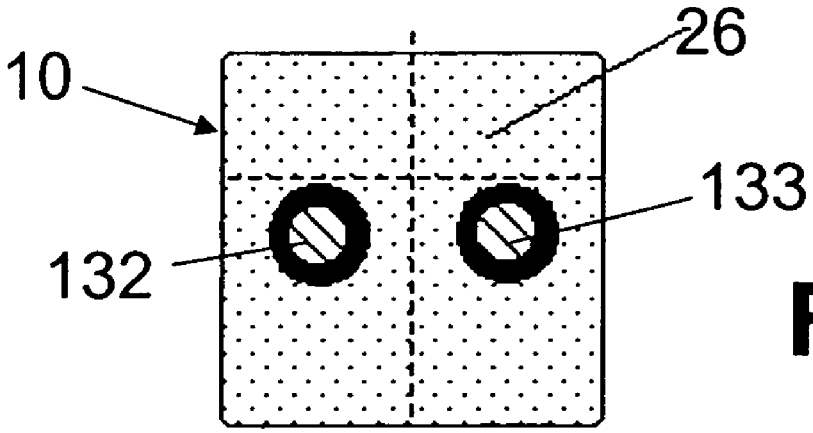
FIG. 8C is a bottom view of the block of FIGS. 8A and 8B illustrating the locations of male snap connectors.

In another illustrated embodiment shown in FIGS. 8A-8C, the first and second contacts 20, 21 adjacent top surface 24 are illustratively formed by snap portions 130 and 131, respectively. As best shown in FIG. 8B, the top contacts 20, 21 are female snap portions 130, 131. Bottom contacts 22, 23 are illustratively male snap portions 132, 133 which are electrically coupled to the circuit board 12. It is understood that the positions of male and female snap portions 130-133 could be reversed. FIG. 8C shows the locations of male snap portions 132 and 133 relative to bottom surface 26. In the illustrated embodiment, snap members 130-133 are magnetic to facilitate coupling of adjacent blocks. Snap portions 130-133 interlock in a conventional manner to further hold the blocks together.

FIG. 8B illustrates that female snap portions 130 and 131 are electrically coupled to the circuit board 12 by connectors 134 and 136, respectively. An internal core 138 may be provided to reduce the amount of elastic material 30 required. A power plug 140 may be provided for coupling to an AC or DC power supply. Therefore, block shown in FIG. 8B is a power block. It is understood that lighted blocks and blank blocks having the snap portions 130-133 may also be provided.

Figure 9A:
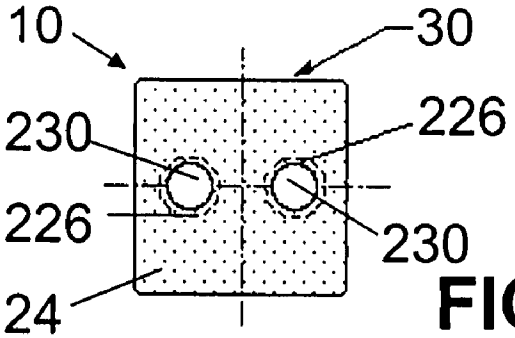
FIG. 9A is a top view of another block of the present invention illustrating locations of ball bearing connectors.
Figure 9B:
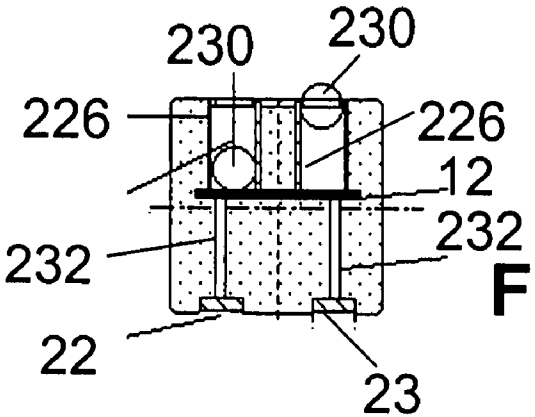
FIG. 9B is a sectional view taken through the block of FIG. 9A illustrating the circuitry for providing an electrical connection between the ball bearing connectors along the top of the block and magnetic connectors on a bottom of the block.
Figure 9C:
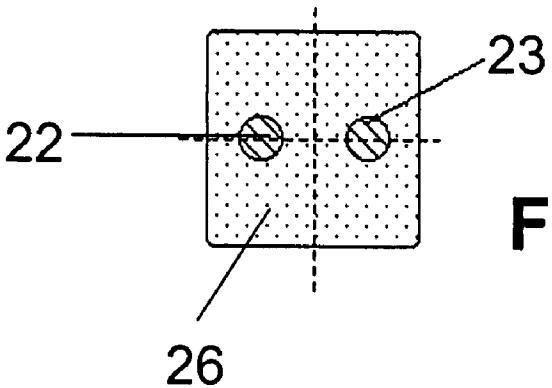
FIG. 9C is a bottom view of the block of FIGS. 9A and 9B illustrating the location of the magnetic connectors on the bottom surface of the block.

In another embodiment shown in FIGS. 9A-9C, the top connectors 20, 21 are illustratively formed by a metal tube 226 recessed in the block 10 and slightly constricted at an outer end adjacent top surface 24. Inside each tube 226 is a ball bearing 230. When magnetic contacts 22, 23 from the another block approach, the magnets 22, 23 attract and lift the metal ball bearings 230 to the top of the tube 226. The ball bearings 230 come into contact with both the tube 226 and the magnetic contacts 22, 23, thereby closing the circuit and holding the two adjacent blocks in place. Magnetic contacts 22, 23 are connected to the circuit board 12 by wires 232 as shown in FIG. 9B. Tubes 226 are also electrically coupled to the circuit board 12.

Figure 10:
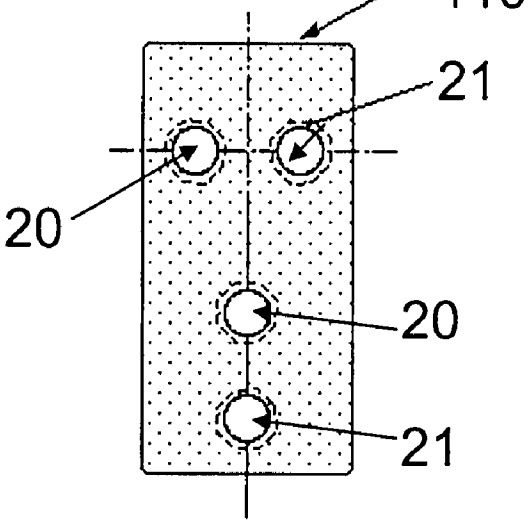
FIG. 10 is a top view of one illustrated embodiment of a power block of the present invention including ball bearing connectors for supplying power to adjacent blocks.

FIG. 10 illustrates a power block 110 first and second pairs of upper contacts 20 and 21 to provide power to blocks which are stacked upon the block 110. Contacts 20 and 21 may be of type shown in FIGS. 7A-7B, 8A and 8B, or 9A and 9B, or any other suitable contact configuration.

Figure 12B:
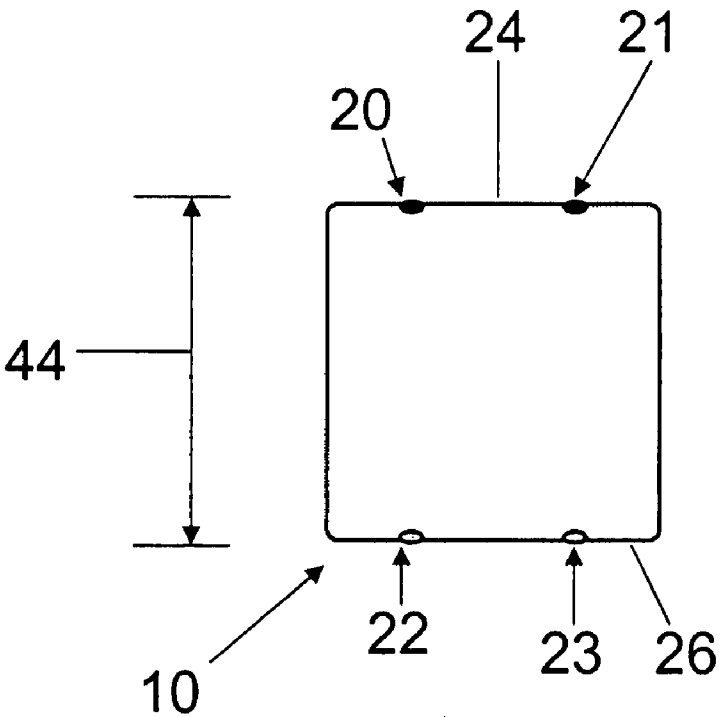
FIG. 12B is a side view of the block of FIG. 12A.
Figure 12A:
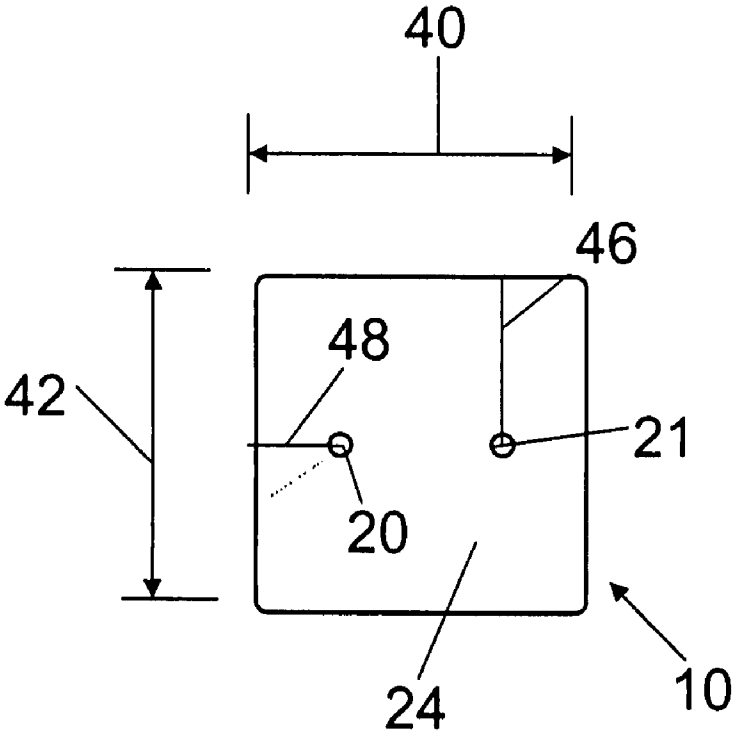
FIG. 12A is a top view of a basic building block of the present invention.

Block unit sizes are selected depending on the particular application. The basic block is 1 unit×1 unit×1 unit (length×width×height) as shown in FIGS. 12A and 12B. The unit size can vary. The block 10 may have connectors on opposite sides or adjacent sides as shown in FIGS. 12A and 12B. FIGS. 12A and 12B illustrate that the length illustrated by dimension 40, the width illustrated by dimension 42, and the height illustrated by dimension 44 are all the same one unit size. Contacts 20 and 21 are 0.5 unit length away from the first pair of opposite edges of the block 10 as illustrated by dimension 46. Contacts 20 and 21 are 0.25 units away from opposite edges of the block 10 as illustrated by dimension 48.

Figure 13B:
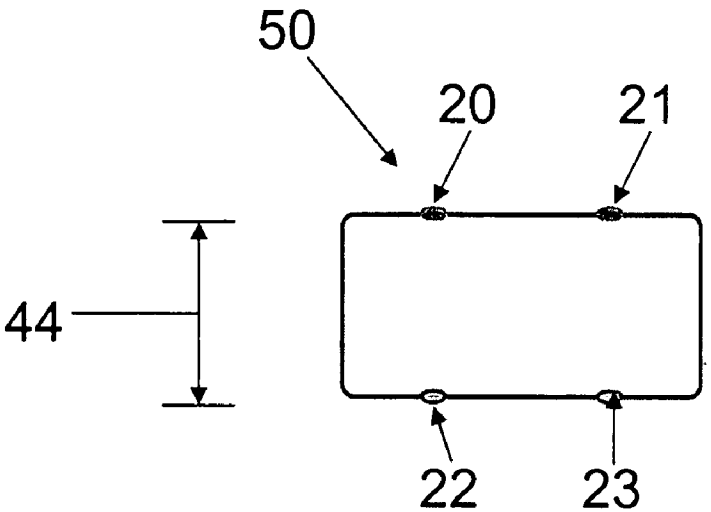
FIG. 13B is a side view of the block of FIG. 13A.
Figure 13A:
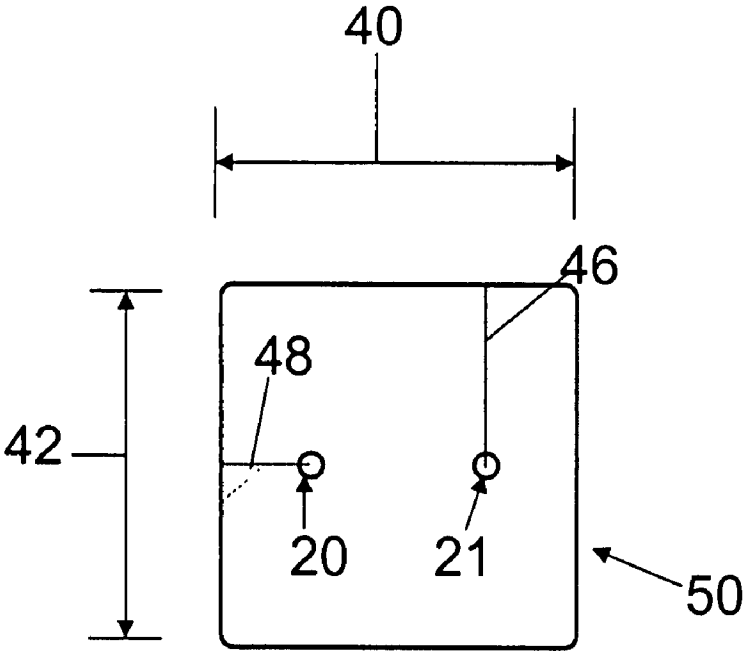
FIG. 13A is a top view of a half block of the present invention.

FIGS. 13A and 13B illustrate a half block 50. The half block 50 has the same length and width dimensions 40 and 42 as the block 10 of FIG. 12A. However, the height dimension 44 of block 50 is only 0.5 unit. Contacts 20 and 21 illustratively have the same spacing as discussed above with reference to FIGS. 12A and 12B.

Figure 14B:
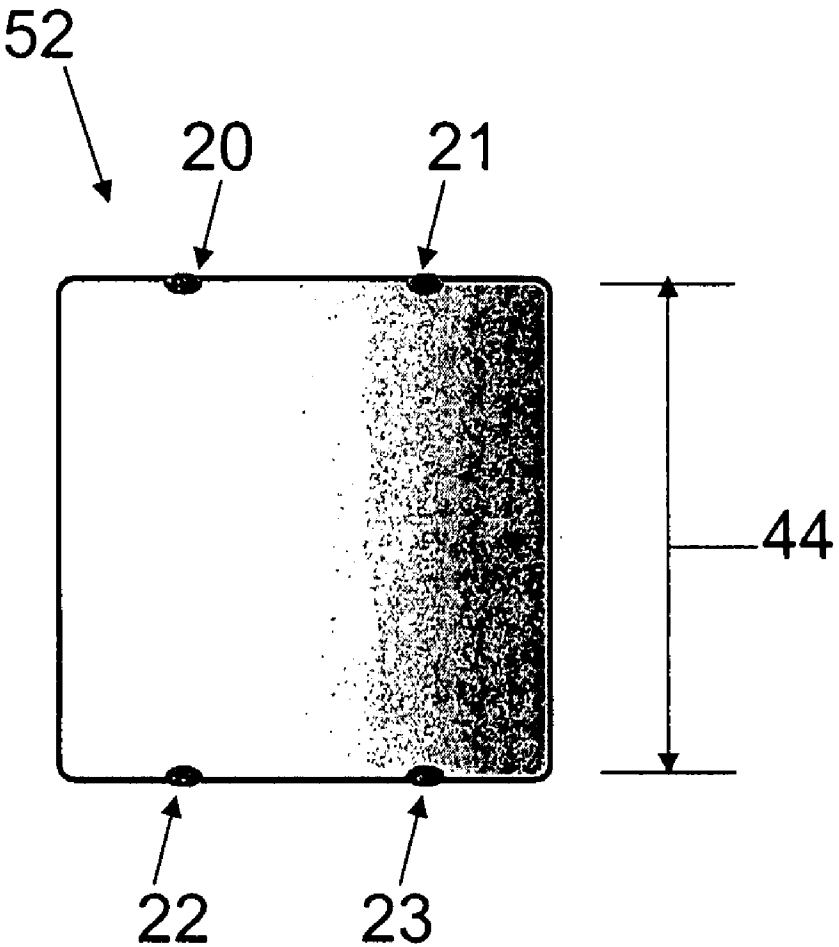
FIG. 14B is a side view of the column block of FIG. 14A.
Figure 14A:
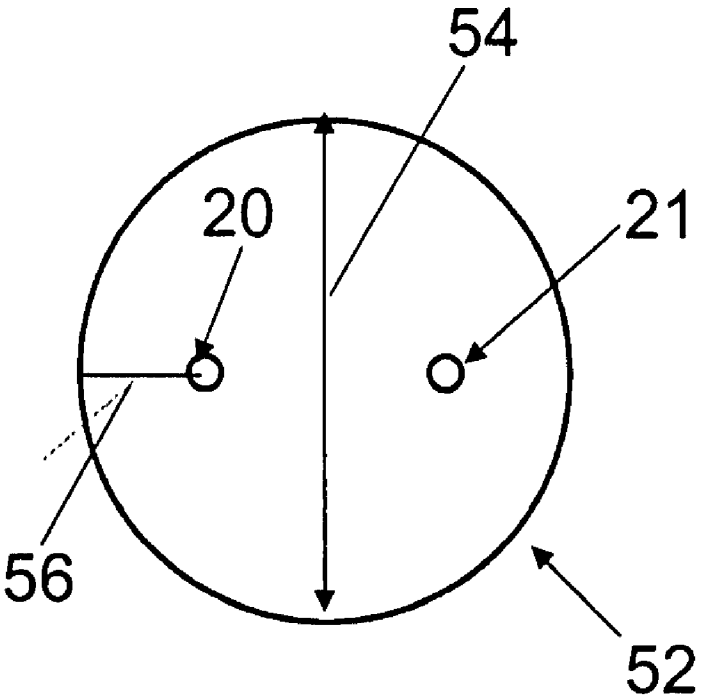
FIG. 14A is a top view of a column block of the present invention.

A column block 52 is illustrated in FIGS. 14A and 14B. A diameter of the column block illustrated by dimension 54 is illustratively equal to one unit. The height of block 52 illustrated by dimension 44 is also one unit. Contacts 20 and 21 are illustratively 0.25 unit away from the closest edge as illustrated by dimension 56.

Figure 15C:
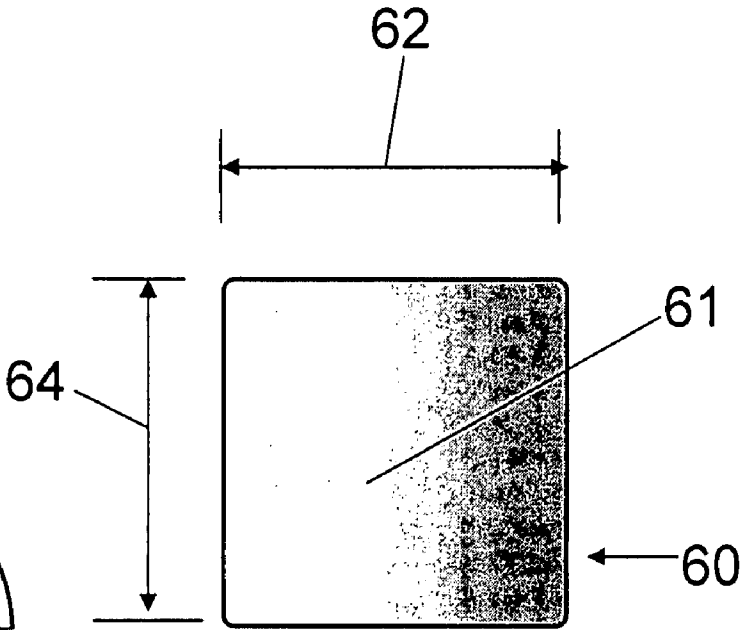
FIG. 15C is a top view of the half column block of FIGS. 15A and 15B.
Figure 15B:
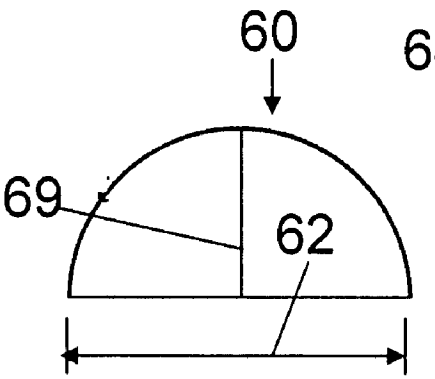
FIG. 15B is a side view of the half column block of FIG. 15A.
Figure 15A:
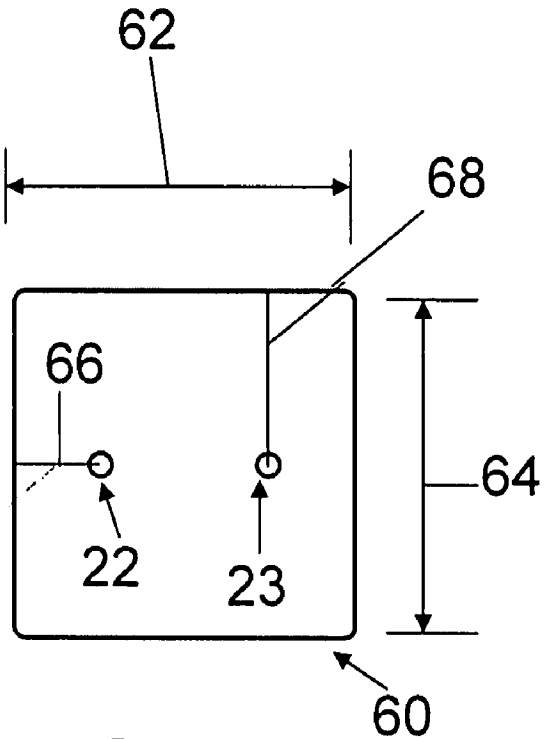
FIG. 15A is a bottom view of a half column block of the present invention.

FIGS. 15A-15C illustrate a half column block 60. A bottom view of half column block 60 is shown in FIG. 15A. Half column block 60 has a length dimension 62 and a width dimension 64 which are illustratively one unit each. Bottom contacts 22 and 23 are illustratively 0.25 unit away from the closest edge as illustrated by dimension 66, and contacts 22 and 23 are 0.5 unit away from the furthest edge as illustrated by dimension 68.

FIG. 15B illustrates a side view of the half column block 60. The bottom surface width dimension 62 is one unit as discussed above. The height dimension 69 is illustratively 0.5 unit. FIG. 15C illustrates a top view of the half column block 60. In the illustrated embodiment, there are no connectors on the top surface 61 of block 60.

Figures 16A, 16B, 16C:
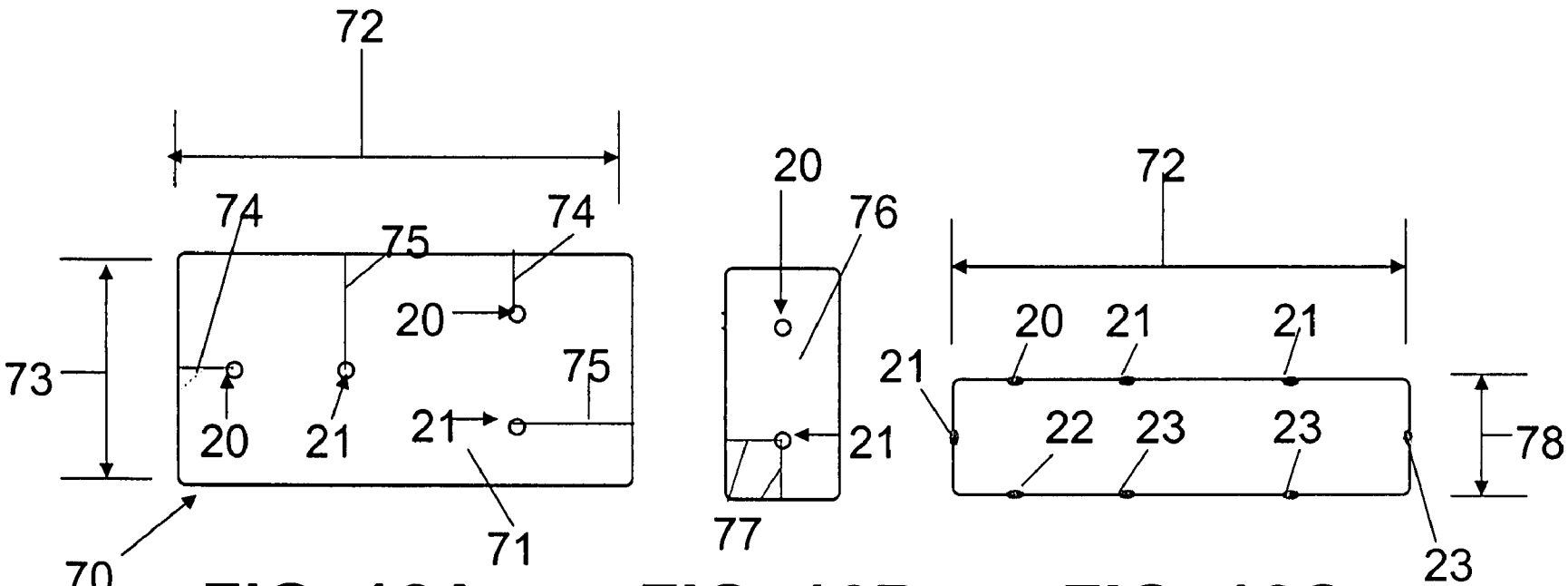
FIG. 16A is a top view of a half rectangle block of the present invention.
FIG. 16B is an end view of the half rectangle block of FIG. 16A showing connectors on an end face of the block.
FIG. 16C is a side view of the blocks of FIGS. 16A and 16B.

FIGS. 16A-16C illustrate a half rectangle block 70. The half rectangle block 70 includes two pairs of contacts 20 and 21 on a top surface 71. Half rectangle block 70 has a length dimension of two units as illustrated by dimension 72 and a width dimension of one unit as illustrated by dimension 73. Contacts 20 and 21 are 0.25 units away from the closest edge as illustrated by dimension 74 and 0.5 units away from the furthest edge as illustrated by dimensions 75. FIG. 16B is an end view of the half rectangle block 70 showing an end wall 76 having contacts 20 and 21. Contacts 20 and 21 are each 0.25 unit away from the closest edge as illustrated by dimensions 77. FIG. 16C is a side view of the half rectangle block 70 illustrating that a height of half rectangle block 70 illustrated by dimension 78 is 0.5 unit.

Figure 17C:
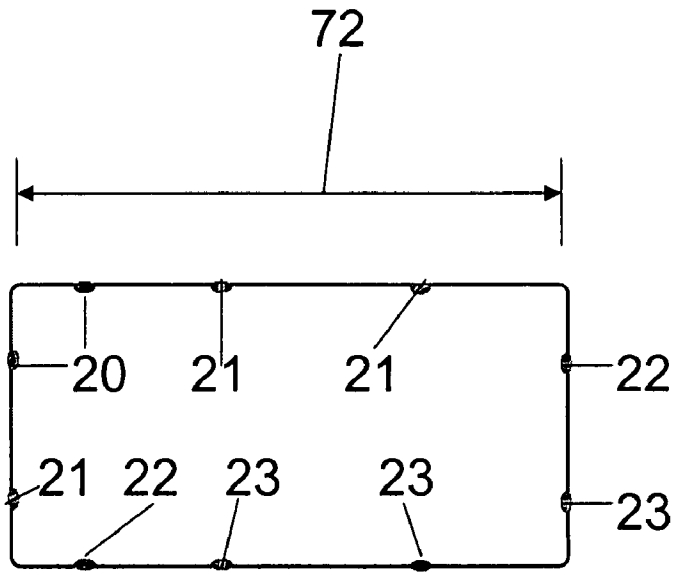
FIG. 17C is a side view of the blocks of FIGS. 17A and 17B.
Figure 17B:
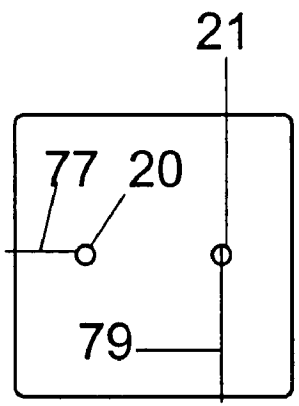
FIG. 17B is an end view of the block of Fig. showing connectors on an end face of the block.
Figure 17A:
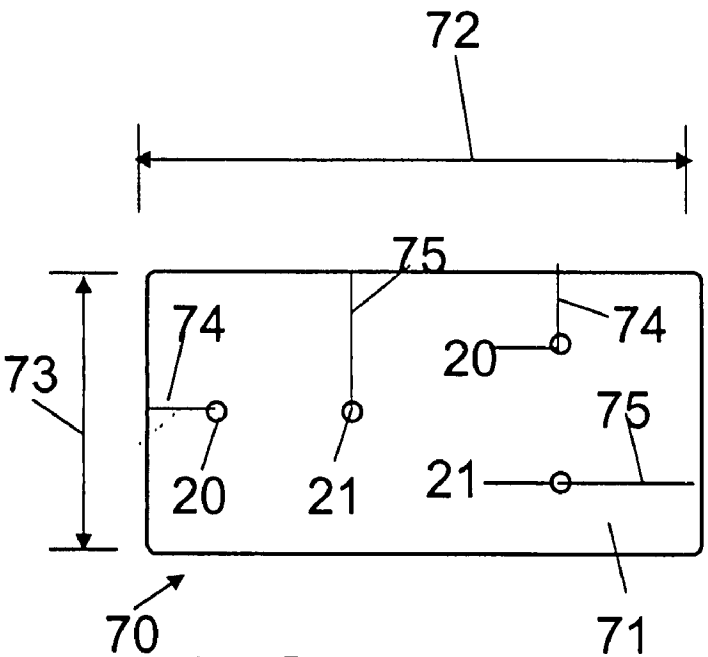
FIG. 17A is a top view of a rectangle block of the present invention.

FIGS. 17A-17C illustrate a full rectangle block 80. The full rectangular block 80 is similar to the half rectangle block 70 except that the height dimension illustrated by dimension 78 in FIG. 17C is one unit. Therefore, the contacts 20 and 21 on end wall 76 are 0.25 unit away from the closest edge as illustrated by dimension 77 and 0.5 unit away from the furthest edge as illustrated by dimension 79 in FIG. 17B.

Figure 18:
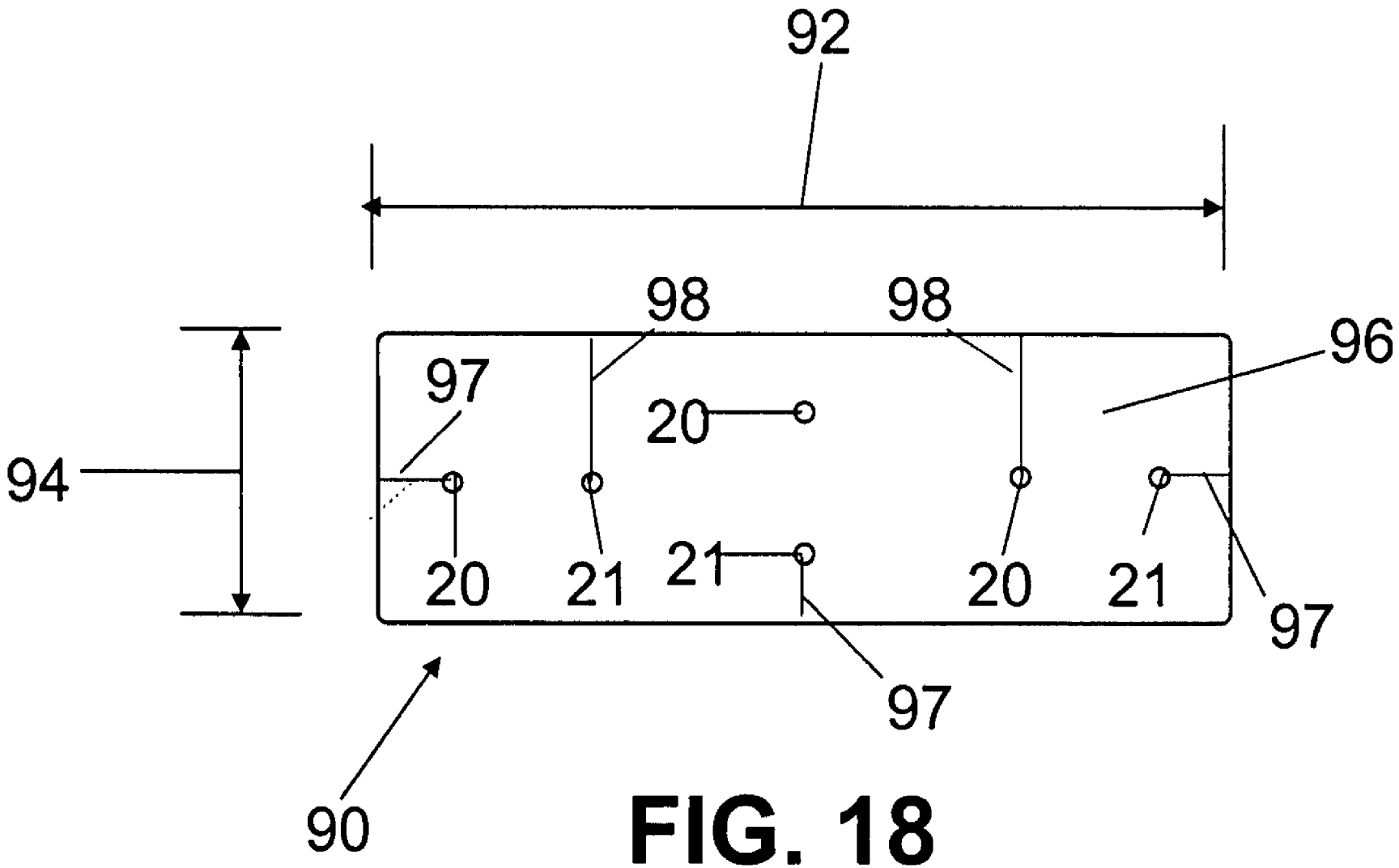
FIG. 18 is a top view of a larger rectangle block of the present invention.

FIG. 18 illustrates a long rectangle block 90 in accordance with another illustrated embodiment of the present invention. In this illustrated embodiment, the block 90 has a length of 3 units as illustrated by dimension 92 and a width of 1 unit as illustrated by dimension 94. The long rectangle block 90 illustratively includes three different contacts pairs 20, 21 on top surface 96. Rectangle block 90 also includes contact pairs 22, 23 on a bottom surface of the block 90 (not shown in FIG. 18). Contacts 20 and 21 are illustratively 0.25 units away from the closest edge as illustrated by dimensions 97, and 0.5 unit away from the furthest edge as illustrated by dimensions 98. Therefore, three separate single unit blocks may be stacked upon the top surface 96 of the long rectangle block 90 shown in FIG. 18.

It is understood that blocks having different shapes or configurations may be used in accordance with the present invention. Other block shapes illustratively include, for example, triangle blocks and bridge blocks.

It is also understood that connectors on blocks can be placed on opposite sides of the blocks or on adjacent sides of the block or both adjacent and opposite. This facilitates coupling adjacent blocks together.

While the invention has been illustrated and described in detail in the drawings and foregoing description, such description is to be considered as exemplary and not restrictive in character. It is understood that only exemplary embodiments have been shown and described and that changes and modifications that come within the scope and spirit of the invention are desired to be protected.

What is claimed is:

1. A block apparatus comprising:

a body formed from an elastic material;

a first light source and a second light source located within the body, the first light source being a different color than the second light source;

first and second conductors to conduct electricity though the body from an adjacent block to supply power to the first and second light sources; and first and second contacts located adjacent a surface of the body and coupled to the first and second conductors, respectively, the first and second contacts being configured to provide electrical connection to a pair of contacts of the adjacent block in either one of a first polarity and an opposite second polarity orientation, the first light source being illuminated and the second light source being non-illuminated when the first and second contacts are coupled to the pair of contacts of the adjacent block in the first polarity, and the second light source being illuminated and the first light source being non-illuminated when the first and second contacts are coupled to the pair of contacts of the adjacent block in the second polarity.

2. The apparatus of claim 1, further comprising a plastic core surrounding the first and second light sources, the elastic material covering the plastic core.

3. The apparatus of claim 1, further comprising an ambient noise level detector within the body, and a circuit to change the light emitted based on the detected ambient noise.

4. The apparatus of claim 3, wherein the circuit changes the emitted light by at least one of pulsing the light, changing the light color, and changing an intensity of the light based on the detected ambient noise level.

5. The apparatus of claim 1, wherein the first and second light sources each include a plurality of LEDs.

6. The apparatus of claim 1, wherein the elastic material contains an antimicrobial material so that the block is resistant to microbial contamination.

7. The apparatus of claim 1, wherein the elastic material is made from one of silicone, urethane, and rubber.

8. The apparatus of claim 1, wherein the first and second contacts are magnetic contacts adjacent a first surface of the body and further comprising first and second metallic contacts adjacent a second surface of the body.

9. The apparatus of claim 8, wherein the first and second metallic contacts each include a fixed metal tube coupled to the light source and a movable conductive contact located in the metal tube.

10. The apparatus of claim 8, wherein the first and second metallic contacts are a first snap portion, and the first and second magnetic contacts are a second snap portion, the first snap portions being configured to interconnect with second snap portions of an adjacent block to hold adjacent blocks together and to conduct electricity between the adjacent blocks.

11. A block apparatus comprising:

a body;

first and second light source sources located within the body, the first light source being a different color than the second light source;

first and second conductors to conduct electricity though the body and power the light source; and a plurality of contacts located adjacent a surface of the body and coupled to the first and second conductors, the contacts being configured to provide electrical connection to a pair of contacts of a power source in either one of a first polarity and an opposite second polarity orientation, the first light source being illuminated and the second light source being non-illuminated when the contacts are coupled to the pair of contacts of the power source in the first polarity, and the second light source being illuminated and the first light source being non-illuminated when the contacts are coupled to the pair of contacts of the power source in the second polarity, the plurality of contacts including at least one magnetic contact located adjacent a first surface of the body and at least one metallic contact located adjacent a second surface of the body.

12. The apparatus of claim 11, wherein the at least one metallic contact includes a fixed metal tube coupled to the light source and a movable conductive contact located in the metal tube.

13. The apparatus of claim 12, wherein the movable conductive contact is one of a ball bearing and a metal rod.

14. The apparatus of claim 11, wherein the metallic contacts are first snap portions and the magnetic contacts are second snap portions, the first snap portions being configured to interconnect with second snap portions of an adjacent block to hold adjacent blocks together.

15. A block set comprising: at least one power block including a body, at least two contacts on the body, and a source of electricity coupled to the at least two contacts;

a plurality of first blocks, each of the of the first blocks having a body, a pair of first contacts located adjacent to a first surface of the body, a pair of second contacts located adjacent to a second surface of the body, and first and second light sources located within the body, the first and second light sources being electrically coupled between the pairs of first and second contacts, the first light source being a different color than the second light source; and a plurality of second blocks, each of the of the second blocks having a body, a pair of first contacts located adjacent to a first surface of the body, a pair of second contacts located adjacent to a second surface of the body, and a pair of conductors extending through the body to couple the pairs of first and second contacts together to pass electricity through the second block, and wherein the plurality of first and second blocks are selectively stackable on the power block with a pair of first contacts of one block engaged with a pair of second contacts on an adjacent block to conduct electricity through a plurality of stacked blocks so that first blocks in the stack are lighted and second blocks in the stack are non-lighted, and wherein the first pair of contacts of the first blocks are configured to provide an electrical connection to one of the contacts on the power block and the pair of second contacts of a second block in either one of a first polarity and an opposite second polarity orientation, the first light source being illuminated and the second light source being non-illuminated when the first pair of contacts are coupled to one of the contacts on the power block and the pair of second contacts of the second blocks in the first polarity, and the second light source being illuminated and the first light source being non-illuminated when the first and second contacts are coupled to one of the contacts on the power block and the pair of second contacts of the second block in the second polarity.

16. The apparatus of claim 15, wherein the first contacts are metallic contacts and the second contacts are magnetic contacts.

17. The apparatus of claim 16, wherein the metallic first contacts each include a fixed metal tube and a movable conductive contact located in the metal tube.

18. The apparatus of claim 16, wherein the metallic first contacts are first snap portions and the magnetic second contacts are second snap portions, the first snap portions being configured to interconnect with second snap portions of an adjacent block to hold adjacent blocks together.

19. The apparatus of claim 15, wherein the body is formed from an elastic material.

20. The apparatus of claim 11, wherein the at least one metallic contact includes a conductive tubular portion.

21. The apparatus of claim 11, wherein the at least one magnetic contact attracts a movable conductive portion of an adjacent block to conduct electricity between adjacent blocks.

* * * * *